US008523407B2

(12) United States Patent
Huang et al.

(10) Patent No.: US 8,523,407 B2
(45) Date of Patent: Sep. 3, 2013

(54) OPTICAL ELEMENT AND ILLUMINANT DEVICE USING THE SAME

(75) Inventors: Hsin-Chieh Huang, Hukou Township, Hsinchu County (TW); Chia-Song Yen, Hukou Township, Hsinchu County (TW); Shun-Wen Teng, Hukou Township, Hsinchu County (TW)

(73) Assignee: Chun Kuang Optics Corp., Hsinchu County (TW)

( * ) Notice: Subject to any disclaimer, the term of this patent is extended or adjusted under 35 U.S.C. 154(b) by 107 days.

(21) Appl. No.: 13/231,911

(22) Filed: Sep. 13, 2011

(65) Prior Publication Data

US 2013/0063962 A1 Mar. 14, 2013

(51) Int. Cl.
*F21V 5/00* (2006.01)
*F21V 5/04* (2006.01)
*F21V 8/00* (2006.01)

(52) U.S. Cl.
USPC ..... 362/327; 362/332; 362/335; 362/511; 362/522

(58) Field of Classification Search
USPC ..... 362/615–629, 326–340
See application file for complete search history.

(56) References Cited

U.S. PATENT DOCUMENTS

| | | | | |
|---|---|---|---|---|
| 6,356,394 | B1 * | 3/2002 | Glienicke | 359/641 |
| 6,679,621 | B2 | 1/2004 | West et al. | |
| 7,142,769 | B2 * | 11/2006 | Hsieh et al. | 385/146 |
| 7,375,382 | B2 * | 5/2008 | Tessnow | 257/98 |
| 7,433,134 | B2 * | 10/2008 | Chou et al. | 359/726 |
| 8,118,457 | B2 * | 2/2012 | Kanai | 362/327 |
| 2004/0208019 | A1 | 10/2004 | Koizumi et al. | |
| 2006/0067640 | A1 | 3/2006 | Hsieh et al. | |
| 2006/0126343 | A1 * | 6/2006 | Hsieh et al. | 362/327 |
| 2007/0115674 | A1 | 5/2007 | Tessnow | |
| 2007/0139946 | A1 * | 6/2007 | Basile et al. | 362/511 |
| 2011/0140147 | A1 | 6/2011 | Chen et al. | |
| 2012/0140461 | A1 * | 6/2012 | Pickard | 362/225 |

FOREIGN PATENT DOCUMENTS

| | | | |
|---|---|---|---|
| EP | 1698824 | A2 | 6/2006 |
| FR | 2858682 | A1 | 6/2004 |
| JP | 2012209237 | A | 10/2012 |
| KR | 1020060115564 | A | 9/2006 |
| TW | M336394 | U | 7/2008 |
| TW | I312203 | B | 7/2009 |
| WO | WO2009069894 | A2 | 6/2009 |

OTHER PUBLICATIONS

European Search Report issued Oct. 8, 2012.
Korea Patent Office Action issued on Apr. 29, 2013.
Taiwan Patent Office Technical Report issued on Jan. 3, 2013.
Japan Patent Official Action issued on Jun. 18, 2013.

* cited by examiner

*Primary Examiner* — Mariceli Santiago
(74) *Attorney, Agent, or Firm* — Chun-Ming Shih; HDLS IPR Services

(57) ABSTRACT

An optical element is assembled to a light emitting diode (LED) to form an illuminative light source. The optical element includes a transparent main body having a light guiding pillar and an extending part. The light guiding pillar has a top surface and a bottom surface having a recess. The extending part is extended from the circumference of the top surface and an end of the extending part has at least a light-emitting surface. Wherein the LED is disposed on the recess and emits light to the optical element. The extending part guides the light and enlarges the light-emitting angle.

13 Claims, 8 Drawing Sheets

OPTICAL ELEMENT AND ILLUMINANT DEVICE USING THE SAME

BACKGROUND OF THE INVENTION

1. Field of the Invention

The present invention relates to an optical element, and in particular to an optical element which can enlarge light emitting angle of light.

2. Description of Prior Art

A light emitting diode (LED) is a kind of semiconductor device, which exploits the property of direct-bandgap semiconductor material to convert electric energy into light energy efficiently and has the advantages of long service time, high stability and low power consumption and is developed to replace the traditional non-directivity light tube and incandescent lamp.

The LED is a point-like light source and has high directivity so that the lighting surface of the LED is narrower than that of the traditional light sources, and the luminous intensity of the LED is gradually reduced while the lighting distance is increased, so that the LED is more suitable for providing short-distance and small area lighting fixture, such as table lamp.

In order to solve the mentioned problem, many manufacturers assemble and arrange multiple LEDs to centralize light for solving the problem of narrow lighting range. However, the required power for driving the LEDs is increased when the number of the LEDs is increased, therefore, the effect of saving energy cannot be achieved. Moreover, the price of LED lamp is far higher than the traditional light source so as to reduce the will of using LED lamp.

SUMMARY OF THE INVENTION

Accordingly, the present invention provides an optical element, the optical element can effectively enlarge the emitting angle of light pass through the optical element.

The present invention further provides an illuminant device, the illuminant device provides a light with large emitting angle.

Therefore, the present invention provides an optical element, the optical element is assembled with a light emitting diode (LED) to form an illuminative light source. The optical element includes a transparent main body having a light guiding pillar and an extending part. The light guiding pillar has a top surface and a bottom surface opposite the top surface, the bottom surface has a recess. The extending part is extended from the circumference of the top surface and an end of the extending part has at least a light-emitting surface, wherein the LED is disposed on the recess and emits light to the optical element.

The present invention further provides an illuminant device, the illuminant device includes a circuit board, an LED, an optical element, a cover and a heat sink element. The LED is disposed on the circuit. The optical element includes a light guiding pillar and an extending part. The light guiding pillar has a top surface and a bottom surface opposite to the top surface. The bottom surface has a recess, the LED is disposed on the recess. The extending part is extended from the circumference of the top surface and an end of the extending part has a least a light-emitting surface. The cover is made of transparent material. The heat sink element is assembled with the cover such that the LED and the optical element are arranged between the cover and the heat sink element.

The optical element of the present invention uses the extending part which is extended from the circumference of the top surface to guide the light entered the optical element so that the light can be refracted by the extending part or reflected to the light-emitting surface and emitting from the light-emitting surface to enlarge the light-emitting angle of light passed through the optical element. Moreover, charging an included angle formed between the light-emitting surface and the bottom surface can provide different forms of luminous intensity distribution such that the optical element can apply in different lighting field.

BRIEF DESCRIPTION OF DRAWING

The features of the invention believed to be novel are set forth with particularity in the appended claims. The invention itself, however, may be best understood by reference to the following detailed description of the invention, which describes an exemplary embodiment of the invention, taken in conjunction with the accompanying drawings, in which:

DETAILED DESCRIPTION OF THE INVENTION

A preferred embodiment of the present invention will be described with reference to the drawings.

Figure 1:
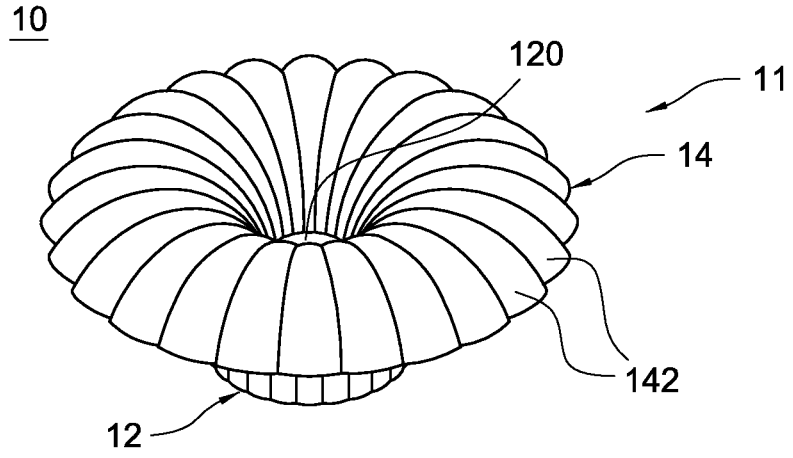
FIG. 1 is a perspective view of an optical element according to a first preferred embodiment of the present invention.
Figure 2:
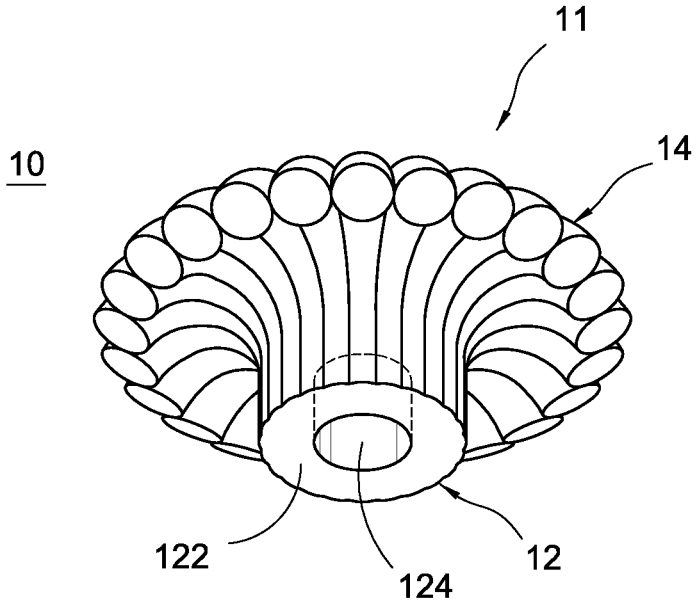
FIG. 2 is another perspective view of the optical element according to the first preferred embodiment of the present invention.

Reference is made to FIG. 1 and FIG. 2, which are perspective views of an optical element from different view angles according to a first preferred embodiment of the present invention. The optical element 10 is applied for disposing on a light emitting diode (LED) 90 such that the luminous intensity distribution of light emitted by the LED can be changed and the emitting angle of the light can be enlarged. The LED 90 is, but not limited to, a LED chip, other equivalent elements can be used without departing from the scope of the present invention.

The optical element 10 can be integrally-formed by plastic, glass, silicon rubber, silicon resin or other light transparent material by injection molding. The optical element 10 has a transparent main body 11. The main body 11 includes a light guiding pillar 12 and an extending part 14. In this embodiment, the light guiding pillar 12 is, but not limited to, a cylinder. In the practical application, the light guiding pillar can be a triangular prism, a tetragonal prism or polygonal prisms. The light guiding pillar 12 has a top surface 120 and a bottom surface 122 opposite to the top surface 120. The bottom surface 122 is designed as a plane and has a recess 124. In this embodiment, the recess 124 disposed on the central of the bottom surface 122 is concave toward the top surface 120 and an opening of the recess 124 is of circular shape. In the practical application, the opening can be any geometric form. The LED 90 is disposed on the recess 124 and emits light to the optical element 10.

The extending part 14 having a plurality of light guide strips 142 is connected to the light guiding pillar 12 and extended from the circumference of the top surface 120. Multiple light-emitting surfaces 140 are disposed on the end of the light guide strips 142. An included angle θ is formed between the light-emitting surface 140 and the bottom surface 122. In this embodiment, the included angle θ is an obtuse angle, which is larger than ninety degrees.

In the practical application, the LED 90 is disposed in the recess 124 and emits light to the optical element 10. The light is guided by the light guiding pillar 12 and emits to the top surface 120 and the extending part 14 by refraction or emits form the light-emitting surface 140 by reflecting by the extending part 14. The extending part can effectively guide light to the light-emitting surface 140 to enhance the light-emitting angle. The luminous intensity distribution of the optical element 10 is shown in FIG. 4.

Figure 4:
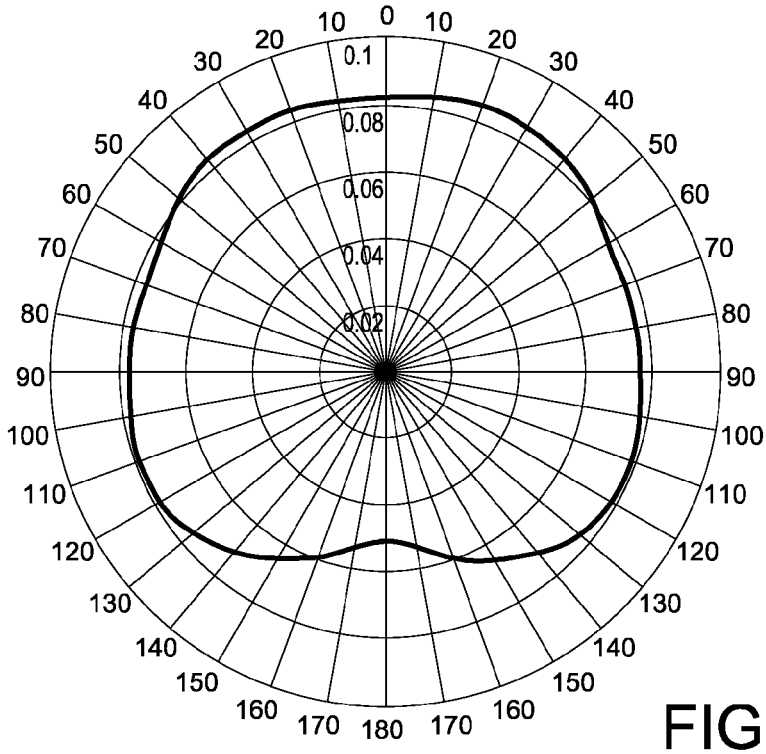
FIG. 4 is a schematic view of the luminous intensity distribution of the optical element according to the present invention.

Reference is made to FIG. 4, which is a schematic view of the luminous intensity distribution of the optical element according to the present invention. The luminous intensity of the light pass through the optical element 10 distributes in 180 degrees from the both side of an optical axis. In more particularly, the luminous intensity is uniform distribution between 0 and 130 degrees and the luminous intensity between 130 and 180 degrees is larger than the 5 percent of the total luminous intensity. As shows in FIG. 4, the optical element 10 can effectively enlarge the emitting angle of the light and enhance the uniformity of light.

Figure 5:
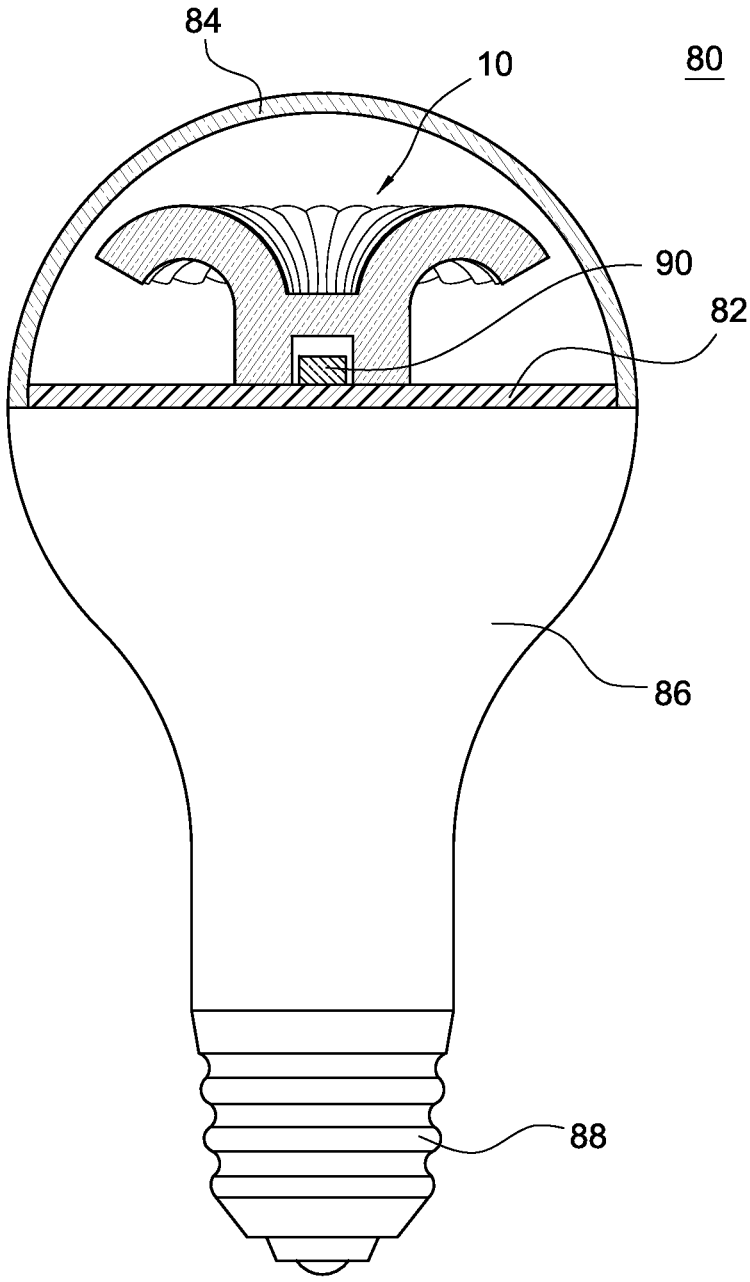
FIG. 5 is a sectional view of an illuminant device according to the present invention.

Reference is made to FIG. 5, which is a sectional view of an illuminant device according to the present invention. The illuminant device 80 includes a circuit board 82, an LED 90, an optical element 10, a cover 84, a heat sink element 86 and a conductive connector 88. The LED 90 is disposed on the circuit board 82 and electrically connected thereto. In this embodiment, the circuit board 82 is provided with conductive traces (not shown) and soldering pads (not shown) thereon to mount the LED 90. The LED 90 is, but not limited to, an LED chip.

Figure 3:
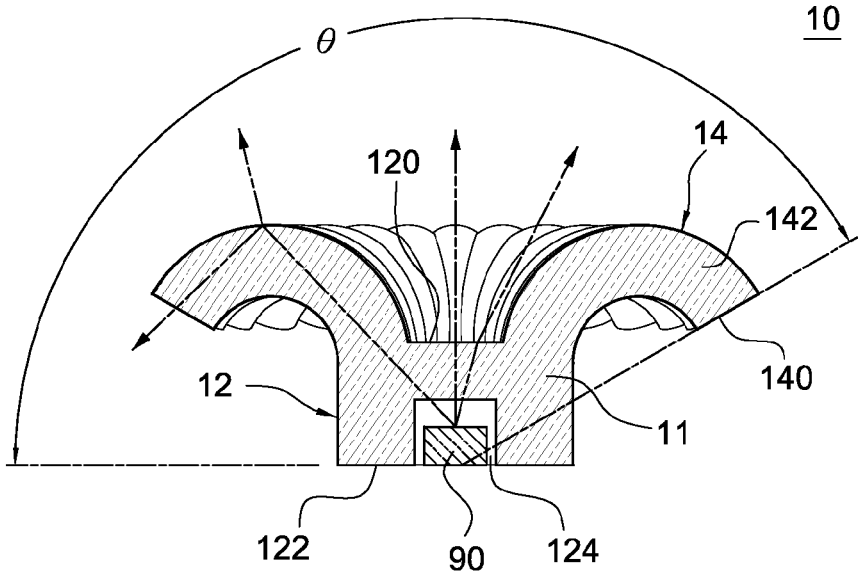
FIG. 3 is a sectional view of the optical element according to the first preferred embodiment of the present invention.

The optical element 10 is disposed on the circuit board 82 and located on the LED 90. With reference again to FIG. 3, the optical element 10 has a transparent main body 11 including a light guide pillar 12 and an extending part 14. The light guide pillar 12 is, but not limited to, a cylinder. The light guide pillar 12 has a top surface 120 and a bottom surface 122. The bottom surface 122 is a plane and has a recess 124. In this embodiment, the recess 124 disposed on the central of the bottom surface 122 is concave toward the top surface 120 and an opening of the recess 124 is, but not limited to, of circular shape. The LED 90 is disposed on the recess 124 and emits light to the optical element 10. The extending part 14 having a plurality of light guide strips 142 is connected to the light guiding pillar 12 and extended from the circumference of the top surface 120. Multiple light-emitting surfaces 140 are disposed on the end of the light guide strips 142. An included angle θ is formed between the light-emitting surface 140 and the bottom surface 122. In this embodiment, the included angle θ is an obtuse angle, which is larger than ninety degrees.

With reference again to FIG. 5, the cover 84 is formed by light transparent material, and can be designed as transparent form or must form. The cover 84 encloses the circuit board 82, which the LED 90 and the optical element 10 are disposed to prevent dust from attaching to the circuit board 84 and prevent moisture from permeating into the illuminant device 80, thus enhancing the light efficiency and prolonging the lifetime of the illuminant device 80.

The heat sink element 86 is assembled with the cover 84 such that the circuit board 82, the LED 90 and the optical element 10 are arranged between the cover 84 and the heat sink element 86. The heat sink element 86 can be made of material for fast removing the heat generated by lighting the LED 90.

The conductive connector 88 is assembled to one side of the heat sink element 86, which is opposite to the cover 84, and electrically connected to the circuit board 82. The conductive connector 88 can be, but not limited to, E26 or E27 connector. The conductive connector 88 is adapted to be connected into the socket of ordinary lamp and electrically connected to an external power. The power is transmitted to the circuit board 82 and lighting the LED 90 through the conductive connector 88. The light emitted from the LED 90 transmits to the top surface 120 and the extending part 14 and emits form the top surface 120 or extending part 14 by refraction or emits form the light-emitting surface 140 by reflecting by the extending part 14.

Figure 6:
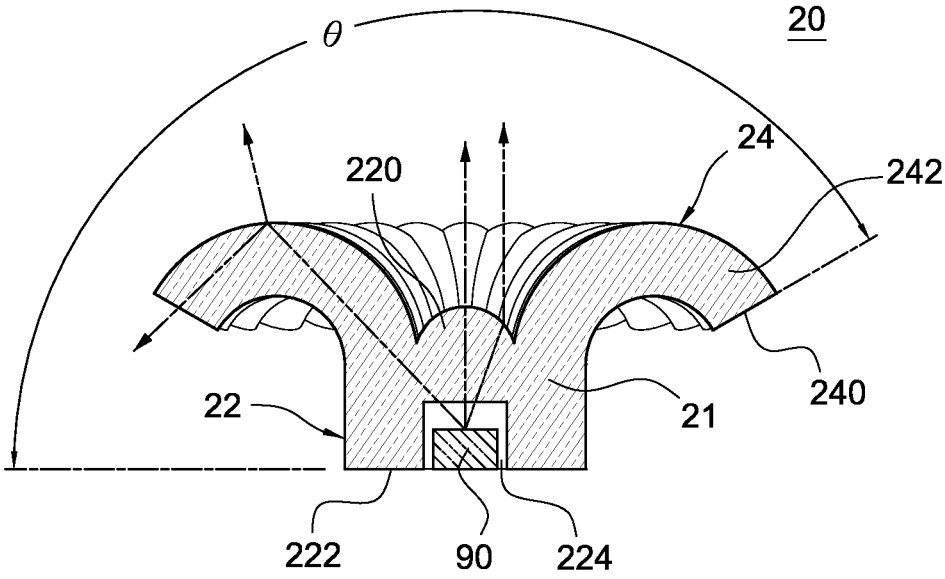
FIG. 6 is a sectional view of an optical element according to a second preferred embodiment of the present invention.

Reference is made to FIG. 6, which is a sectional view of an optical element according to a second preferred embodiment of the present invention. The optical element 20 has a transparent main body 21 and the main body 21 includes a light guide pillar 22 and an extending part 24. The light guiding pillar 22 is, but not limited to, a circular pillar. The light guiding pillar 22 has a top surface 220 and a bottom surface 222 opposite to the top surface 220. The top surface 220 is convex toward a direction which is opposite the bottom surface 222, and the top surface 220 is, but not limited to, of arc convex, which can effectively enhance the uniformity of light emitted by the top surface 220. The bottom surface 222 is a plane and has a recess 224. The recess 224 disposed on the central of the bottom surface 222 is concave toward the top surface 220 and an opening of the recess 224 is, but not limited to, of circular shape.

The extending part 24 having a plurality of light guide strips 242 is connected to the light guiding pillar 22 and extended from the circumference of the top surface 220. Multiple light-emitting surfaces 240 are disposed on the end of the light guide strips 242. An included angle θ is formed between the light-emitting surface 240 and the bottom surface 222. In this embodiment, the included angle θ is an obtuse angle, which is larger than ninety degrees.

The LED 90 is disposed on the recess 224 and emits light to the optical element 20. The light transmits to the top surface 220 and the extending part 24 and emits form the top surface 220 or extending part 24 by refraction or emits form the light-emitting surface 240 through reflecting by the extending part 24.

Figure 7:
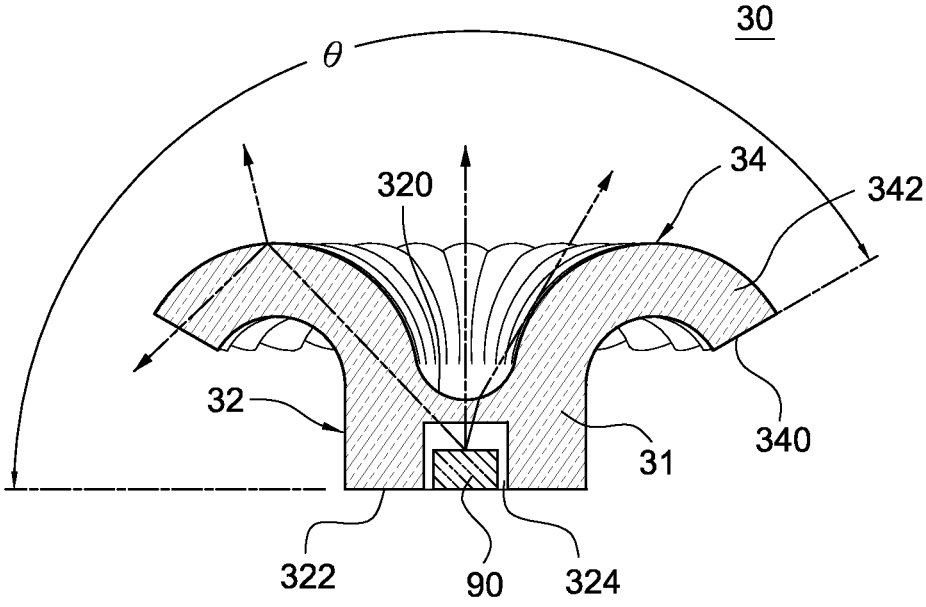
FIG. 7 is a sectional view of an optical element according to a third preferred embodiment of the present invention.

Reference is made to FIG. 7, which is a sectional view of an optical element according to a third preferred embodiment of the present invention. The optical element 30 has a transparent main body 31 and the main body 31 includes a light guide pillar 32 and an extending part 34. The light guide pillar 32 is, but not limited to, a circular pillar. The light guiding pillar 32 has a top surface 320 and a bottom surface 322 opposite to the top surface 320. The top surface 320 is concave toward the bottom surface 322 such that diverges light passed through and the top surface 320 is, but not limited to, of arc concave. The bottom surface 322 is a plane and has a recess 324. The recess 324 disposed on the central of the bottom surface 322 is concave toward the top surface 320 and an opening of the recess 324 is, but not limited to, of circular shape.

The extending part 34 having a plurality of light guide strips 342 is connected to the light guiding pillar 32 and extended from the circumference of the top surface 320. Multiple light-emitting surfaces 340 are disposed on the end of the light guide strips 342. An included angle θ is formed between the light-emitting surface 340 and the bottom surface 322. In this embodiment, the included angle θ is an obtuse angle, which is larger than ninety degrees.

Figure 8:
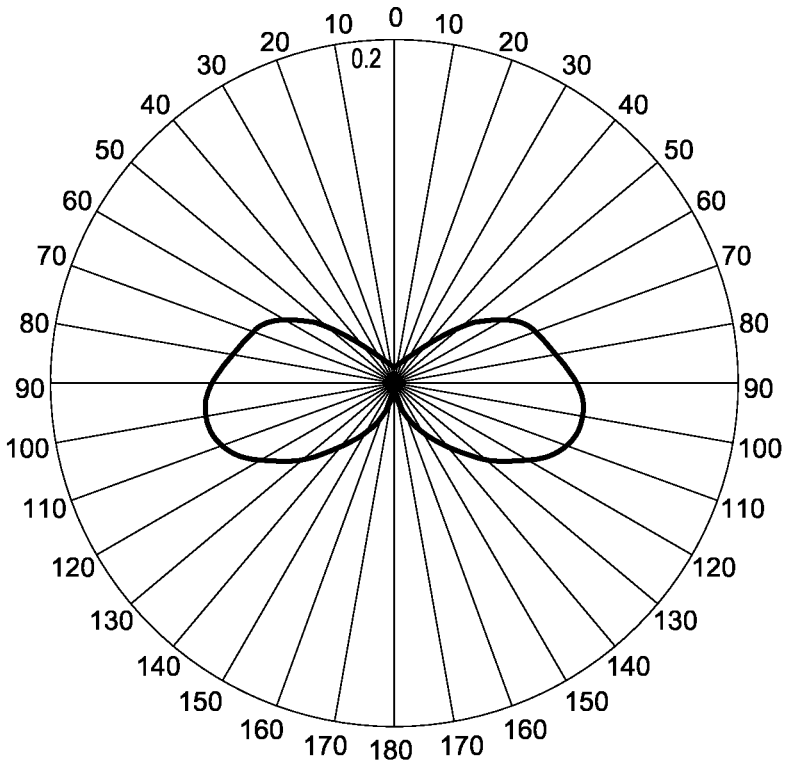
FIG. 8 is a schematic view of the luminous intensity distribution of the optical element according to the present invention.

The LED 90 is disposed on the recess 324 of the optical element 30. Partial light emitted by the LED 90 and entered to the optical element 30 emits form the top surface 320, the top surface 320 diverges the light. Other light emitted by the LED 90 and entered to the optical element 30 emits from the extending part 34 by refraction or emits form the light-emitting surface 340 through reflecting by the extending part 34. The luminous intensity distribution of the optical element 30 is shown in FIG. 8, and the light focus at an inclined direction about 50 to 130 degrees at both side of an optical axis.

Figure 9:
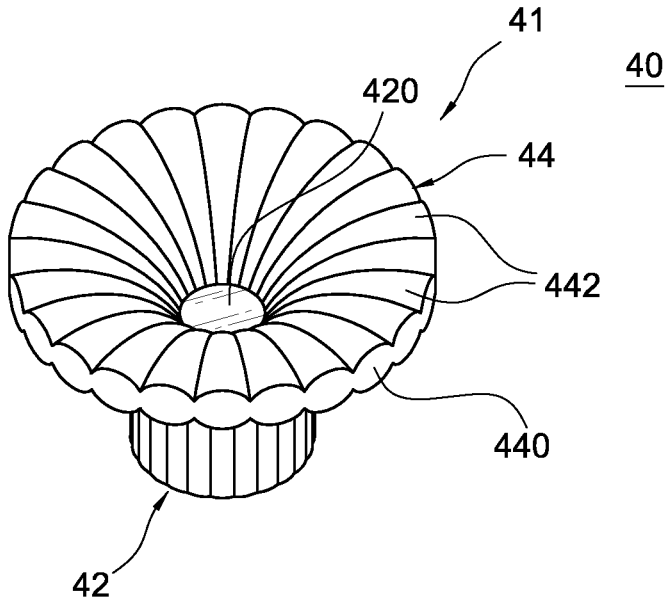
FIG. 9 is a perspective view of an optical element according to the fourth preferred embodiment of the present invention.
Figure 10:
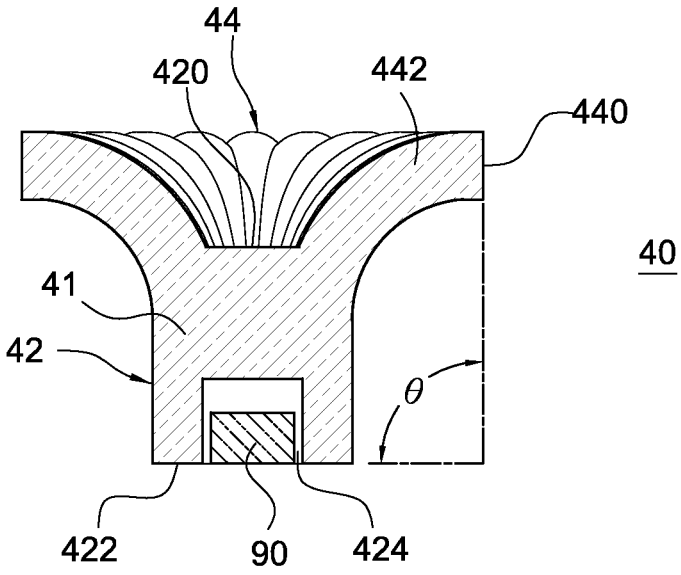
FIG. 10 is a sectional view of the optical element according to the fourth preferred embodiment of the present invention.

Reference is made to FIG. 9 and FIG. 10, which are respectively a perspective view and a sectional view of an optical element according to the fourth preferred embodiment of the present invention. The optical element 40 has a transparent main body 41 including a light guide pillar 42 and an extending part 44. The light guiding pillar 42 is, but not limited to, a cylinder. The light guiding pillar 42 has a top surface 420 and a bottom surface 422 opposite to the top surface 420. The bottom surface 422 is a plane and has a recess 424. The recess 424 disposed on the central of the bottom surface 422 is concave toward the top surface 420 and an opening of the recess 424 is, but not limited to, of circular shape. In this embodiment, the top surface 420 is a plane and is substantially parallel to the bottom surface 422. In the practical application, the top surface 420 can be a convex face to enhance the uniformity of the light passed through or a concave face to converge the light passed through.

The extending part 44 having a plurality of light guide strips 442 is connected to the light guiding pillar 42 and extended from the circumference of the top surface 420. Multiple light-emitting surfaces 440 are disposed on the end of the light guide strips 442. An included angle θ is formed between the light-emitting surface 440 and the bottom surface 422. In this embodiment, the included angle θ is a right angle, which is equal to ninety degrees.

Figure 11:
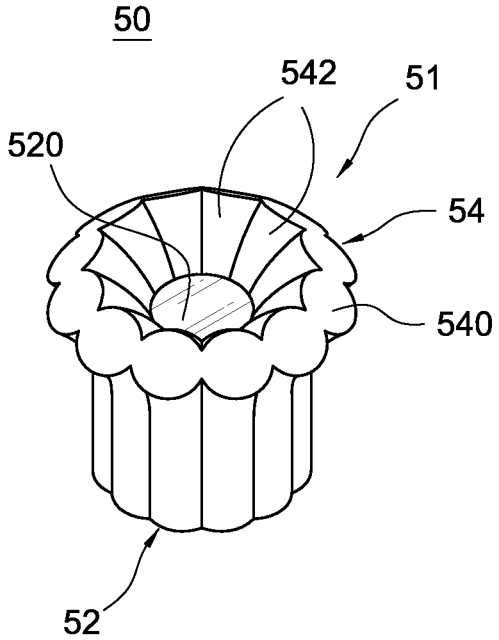
FIG. 11 is a perspective view of an optical element according to the fifth preferred embodiment of the present invention.
Figure 12:
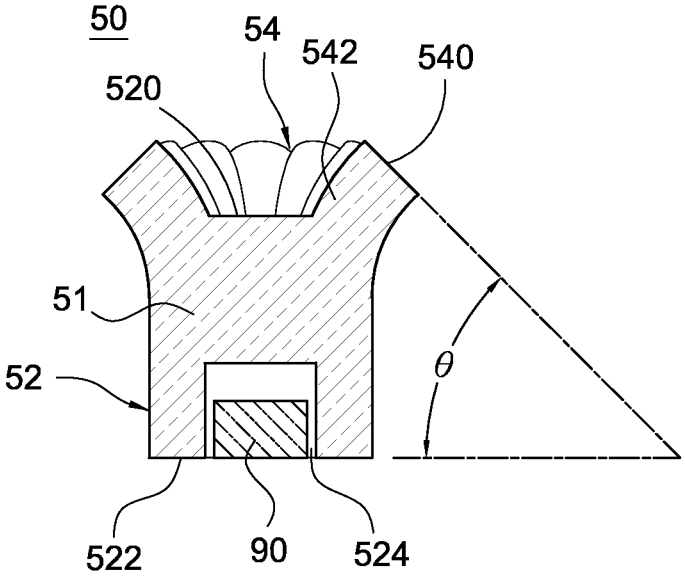
FIG. 12 is a sectional view of the optical element according to the fifth preferred embodiment of the present invention.

Reference is made to FIG. 11 and FIG. 12, which are respectively a perspective view and a sectional view of an optical element according to the fifth preferred embodiment of the present invention. The optical element 50 has a transparent main body 51 including a light guiding pillar 52 and an extending part 54. The light guiding pillar 52 is, but not limited to, a cylinder. The light guiding pillar 52 has a top surface 520 and a bottom surface 522 opposite to the top surface 520. The bottom surface 522 is a plane and has a recess 524. The recess 524 disposed on the central of the bottom surface 522 is concave toward the top surface 520 and an opening of the recess 524 is, but not limited to, of circular shape. In this embodiment, the top surface 520 is a plane and is substantially parallel to the bottom surface 522. In the practical application, the top surface 520 can be a convex face to enhance the uniformity of the light passed through or a concave face to converge the light passed through.

The extending part 54 having a plurality of light guide strips 542 is connected to the light guiding pillar 52 and extended from the circumference of the top surface 520. Multiple light-emitting surfaces 540 are disposed on the end of the light guide strips 542. An included angle θ is formed between the light-emitting surface 540 and the bottom surface 522. In this embodiment, the included angle θ is an acute angle, which is smaller than ninety degrees.

Figure 13:
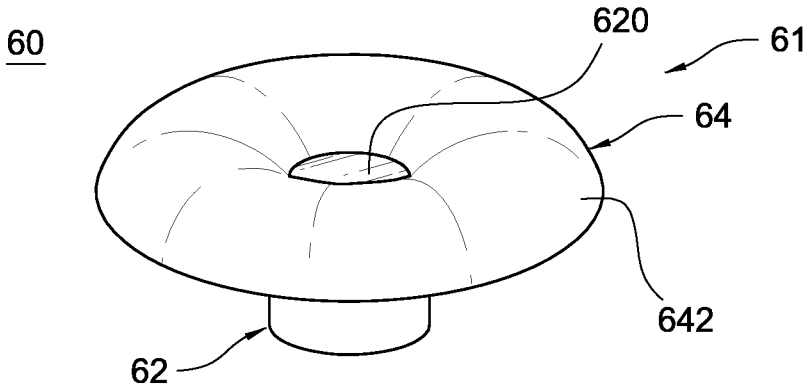
FIG. 13 is a perspective view of an optical element according to a sixth preferred embodiment of the present invention.
Figure 14:
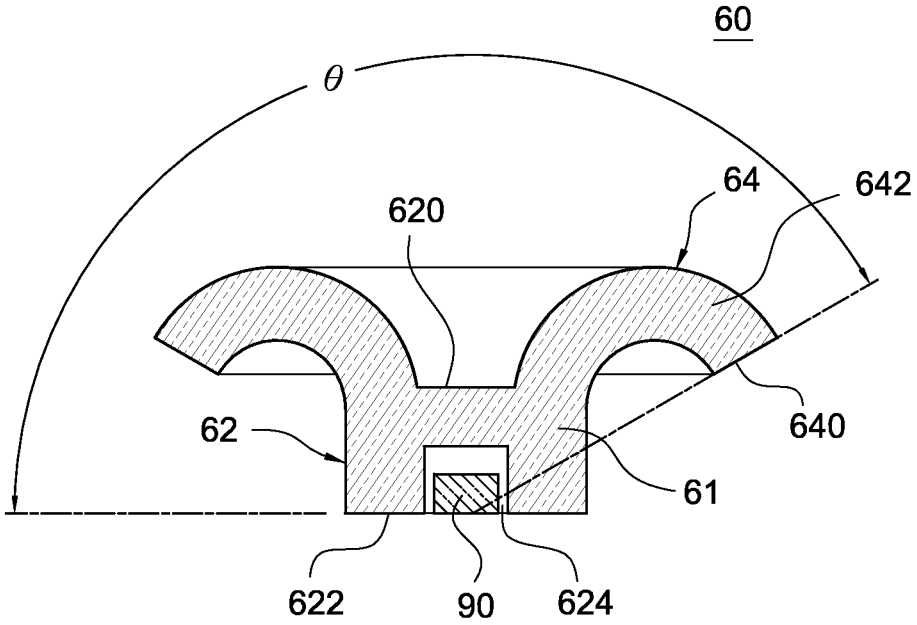
FIG. 14 is a sectional view of the optical element according to the sixth preferred embodiment of the present invention.

Reference is made to FIG. 13 and FIG. 14, which are respectively a perspective view and a sectional view of an optical element according to a sixth preferred embodiment of the present invention. The optical element 60 has a transparent main body 61 including a light guiding pillar 62 and an extending part 64. The light guiding pillar 62 is, but not limited to, a cylinder. The light guiding pillar 62 has a top surface 620 and a bottom surface 622 opposite to the top surface 620. The bottom surface 622 is a plane and has a recess 624. The recess 624 disposed on the central of the bottom surface 622 is concave toward the top surface 620 and an opening of the recess 624 is, but not limited to, of circular shape. In this embodiment, the top surface 620 is a plane and is substantially parallel to the bottom surface 622. In the practical application, the top surface 620 can be a convex face to enhance the uniformity of the light passed through or a concave face to converge the light passed through.

The extending part 64 having a plurality of light guide strips 642 is connected to the light guiding pillar 62 and extended from the circumference of the top surface 620. A light-emitting surface 640 are disposed on the end of the light guide strips 642. An included angle θ is formed between the light-emitting surface 640 and the bottom surface 622. In this embodiment, the included angle θ is an obtuse angle, which is larger than ninety degrees. In the practical application, the included angle θ can be a right angle or an acute angle for adjusting the light-emitting angle. The LED 90 is disposed on the recess 624 and emits light to the optical element 60.

To sum up, in the present invention, the optical element uses the extending part which is extended from the circumference of the top surface to guide the light entered the optical element so that the light can be refracted by the extending part or reflected to the light-emitting surface and emitting from the light-emitting surface to enlarge the light-emitting angle of light passed through the optical element. Moreover, charging an included angle formed between the light-emitting surface and the bottom surface can provide different forms of luminous intensity distribution such that the optical element can apply in different lighting field.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An optical element assembled with a light emitting diode (LED) to form an illuminative light source, the optical element comprising:

a transparent main body, comprising:

a light guiding pillar having a top surface and a bottom surface opposite the top surface, the bottom surface having a recess; and plurality of light guiding strips connected with each other to surround a cylindrical surface of the light guiding pillar and extend from a circumference of the top surface and an end of each light quidinq strip having a light-emitting surface;

wherein the LED is disposed within the recess and emits light to the optical element.

2. The optical element in claim 1, wherein an included angle formed between the light-emitting surface and the bottom surface is an obtuse angle being larger than ninety degrees.

3. The optical element in claim 1, wherein an included angle formed between the light-emitting surface and the bottom surface is a right angle being equaled to ninety degrees.

4. The optical element in claim 1, wherein an included angle formed between the light-emitting surface and the bottom surface is an acute angle being smaller than ninety degrees.

5. The optical element in claim 1, wherein the top surface is a plane.

6. The optical element in claim 1, wherein the top surface is a convex or concave.

7. An illuminant device, comprising:

a circuit board;

a light emitting diode (LED) disposed on the circuit;

an optical element, comprising:

a light guiding pillar having a top surface and a bottom surface opposite to the top surface, the bottom surface having a recess, the LED disposed within the recess;

plurality of light guiding strips connected with each other to surround a cylindrical surface of the light guiding pillar and extend from a circumference of the top surface and an end of each light guiding strip having a light-emitting surface;

a cover made of transparent material; and a heat sink element assembled with the cover such that the LED and the optical element are arranged between the cover and the heat sink element.

8. The illuminant device in claim 7, wherein an included angle formed between the light-emitting surface and the bottom surface is an obtuse angle being larger than ninety degrees.

9. The illuminant device in claim 7, wherein an included angle formed between the light-emitting surface and the bottom surface is a right angle being equaled to ninety degrees.

10. The illuminant device in claim 7, wherein an included angle formed between the light-emitting surface and the bottom surface is an acute angle being smaller than ninety degrees.

11. The illuminant device in claim 7, wherein the top surface is a plane.

12. The illuminant device in claim 7, wherein the top surface is a convex or concave.

13. The illuminant device in claim 7, further comprising a conductive connector assembled to one side of the heat sink element, which is opposite to the cover, and electrically connected to the circuit board.

* * * * *